United States Patent [19]

Chen

[11] Patent Number: 5,048,312

[45] Date of Patent: Sep. 17, 1991

[54] SLIP-PROOF ELASTIC YARN FEEDING RING DEVICE REMOVABLY MOUNTED ON YARN-FEEDING DRUM

[76] Inventor: Jen-Fu Chen, 220 Berkley St., Saint Lamber, Montreal, Quebec, Canada, J4P 3E1

[21] Appl. No.: 427,513

[22] Filed: Oct. 27, 1989

[51] Int. Cl.[5] ..... B65H 51/06; D04B 15/48

[52] U.S. Cl. ..... 66/132 T

[58] Field of Search ..... 66/125 R, 132 T, 132 R; 242/47.01

[56] References Cited

U.S. PATENT DOCUMENTS

| | | | |
|---|---|---|---|
| 4,004,438 | 1/1977 | Raisin | 66/132 T |
| 4,199,965 | 4/1980 | Wilson | 66/125 R |
| 4,355,747 | 10/1982 | Vinas | 66/132 T |
| 4,457,144 | 7/1984 | Sawazaki | 66/132 T |
| 4,545,543 | 10/1985 | Plucknett | 242/47.01 |

FOREIGN PATENT DOCUMENTS

| | | | |
|---|---|---|---|
| 2141482 | 1/1973 | France | 66/132 R |
| 936291 | 9/1963 | United Kingdom | 66/132 R |
| 2065723 | 7/1981 | United Kingdom | 66/132 T |
| 2109825 | 6/1983 | United Kingdom | 66/132 T |
| 2156867 | 10/1985 | United Kingdom | 66/132 T |

*Primary Examiner*—Werner H. Schroeder
*Assistant Examiner*—John J. Calvert
*Attorney, Agent, or Firm*—Lalos & Keegan

[57] ABSTRACT

A slip-proof elastic yarn-feeding ring device removably fitted to the circumference of a yarn-feeding drum whereby a yarn is pressed between a yarn-feeding belt and the ring device and steadily forward carried by the yarn-feeding belt without slipping movement. The diameter of the ring device is smaller than that of the yarn-feeding drum so that when the ring device is extended to ring the yarn-feeding drum, the ring device closely binds a portion of the circumference of the yarn-feeding drum via its elastic binding force.

8 Claims, 4 Drawing Sheets

SLIP-PROOF ELASTIC YARN FEEDING RING DEVICE REMOVABLY MOUNTED ON YARN-FEEDING DRUM

BACKGROUND OF THE INVENTION

The present invention relates to a yarn-feeding ring device, and more particularly to a slip-proof elastic yarn-feeding ring device removably mounted on the circumference of a yarn-feeding drum.

In general, the circumference of the conventional yarn-feeding drums include two types: the cage type and the solid type. The yarn-feeding drum of the cage type has an outer circumference formed with plural polished circular rods constructing a fence structure. While the yarn-feeding drum of the solid type has a close outer circumference, both the cage type and solid type yarn-feeding drums have smooth circumferences for a fed yarn to pass therethrough. For example, as shown in FIG. 10, when a yarn 9 is pressed against the smooth circumference of a yarn-feeding drum 1 to be fed via frictional force, by means of a yarn guide 8 mounted on a bracket 5, the yarn 9 is led to enter a belt pressing portion for positive yarn-feeding operation or remove from the same portion to a free smooth portion of the circumference of the yarn-feeding drum for non-feeding operation.

However, when a knitting machine requires numerous yarns and identical yarn-feeding speed with each yarn-feeding drum 1 driven by same yarn-feeding belt 2, the contact area between the yarn-feeding belt 2 and each yarn-feeding drum 1 is greatly reduced and becomes uneven, and therefore, the belt driving speed respective to each yarn 9 is hardly uniform. Furthermore, such speed difference is difficult to be found, and therefore an appropriate adjustment can hardly be exercised to solve the problem, thus making the fabric uneven with poor quality.

Consequently, yarn break ages and operation stop pages occur frequently to reduce the production efficiency.

Concerning the aforesaid problem, a proposal has been used to fit a rubber ring 4 to the whole circumference of the yarn-feeding drum, as shown in FIG. 11. Accordingly, although the abnormal slipping movement existing in positive yarn-feeding operation is effectively eliminated, when a yarn is guided by a yarn guide to leave the belt-pressing portion for non-feeding operation, the yarn can not just slip on the circumference of the yarn-feeding drum without feeding, and a slight irregular yarn-feeding phenomenon still takes place to greatly interfere with the knitting operation, making the fashion and stripe of the fabric confused and uncontrollable.

Therefore, the portion free from the belt pressing force must be smooth. However, if a rubber ring is only fitted to the belt-pressing portion of the circumference of the yarn-feeding drum, the rubber ring will not be fixedly located and creates a nuisance. While if an adhesive is applied to affix the rubber ring to the circumference of the yarn-feeding drum, not only in assembling, the working will be quite difficult to be performed, but also the adhesive applied to the smooth circular rods or the circumference of the yarn-feeding drum is apt to detach therefrom after a period of use and cause troubles.

SUMMARY OF THE INVENTION

It is therefore a primary object of the present invention to provide a removable slip-proof elastic yarn-feeding ring device, which has a diameter smaller than that of the yarn-feeding drum so that it can be extended to fittedly ring a portion of the circumference of the yarn-feeding drum via its elastic binding force whereby a yarn-feeding belt can cooperate with the ring band to press the yarns thereagainst for feeding the yarn without any slipping movement and keeping the contact area between the yarn and yarn-feeding wheel free from affection of numerous yarns, and therefore steadily maintaining the yarn-feeding operation.

It is a further object of the present invention to provide the above elastic ring device, which rings a predetermined portion of the yarn-feeding drum totally via its elastic binding force to perform yarn-feeding and non-feeding operation.

It is still a further objects of the present invention to provide the above elastic ring device, which is manually removably fitted to the yarn-feeding drum. When replaced, no parts are needed to be disassembled from the yarn-feeding drum, and a new elastic ring device can be easily substitutedly attached to the circumference of the yarn-feeding device to maintain the yarn-feeding function thereof and therefore promote the quality of the fabric.

The removable slip-proof elastic yarn-feeding ring device of the present invention is characterized in that the ring device has a diameter slightly smaller than that of the yarn-feeding drum to which the ring device is fitted, and by means of the elasticity of the ring device, it can be extended to closely bind up the first portion of the circumference of the yarn-feeding drum, enabling the first portion to perform yarn-feeding function without slipping. On the other hand, the second portion of the circumference of the yarn-feeding drum remains smooth without yarn-feeding function, whereby the yarn-feeding and non-feeding functions are clearly performed respectively by the first and second portions, and thus the shortcomings existing in prior yarn-feeding drum are totally deleted.

Although the ring device of the present invention appears to be a conventional means, however, since the ring device has a diameter sligthly smaller than that of the yarn-feeding drum, and is fitted around the outer circumference thereof, making itself fixedly located on the first portion of the circumference of the yarn-feeding drum, the function of steady accurate positive yarn-feeding without slipping and the function of non-feeding can be easily performed. As to the above arrangement, no similar art existed precedingly.

The present invention can be best understood through the following description with reference to the accompanying drawings wherein:

DETAILED DESCRIPTION OF THE PREFERRED EMBODIMENTS

Figure 1:
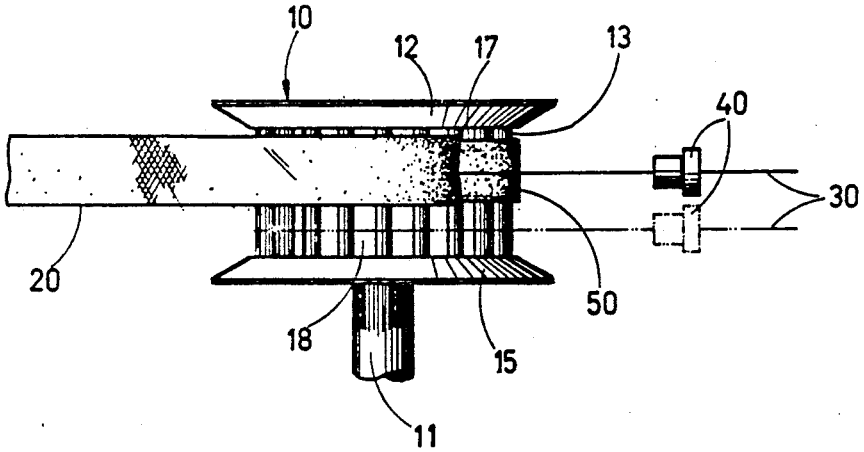
FIG. 1 shows a preferred embodiment of the present invention.
Figure 2:
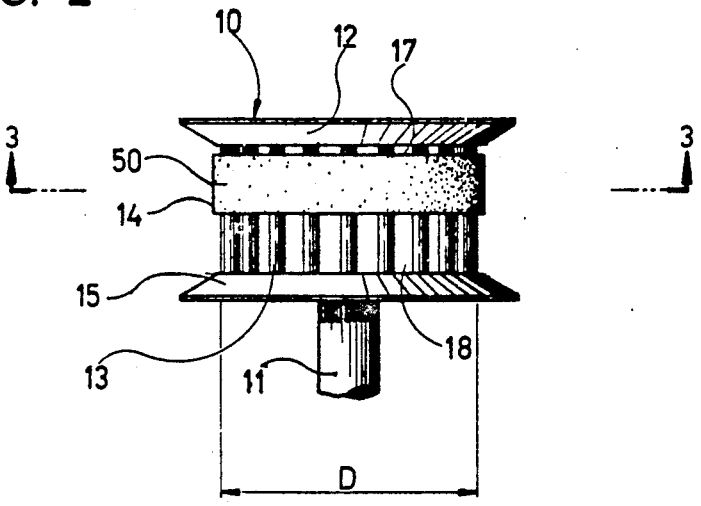
FIG. 2 shows the embodiment of FIG. 1 with the yarn-feeding belt removed.
Figure 3:
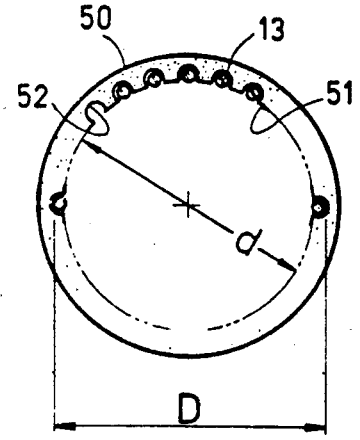
FIG. 3 is a sectional view taken on line 3—3 of FIG. 2, showing the sectional configuration of the ring device.

Now please refer to FIGS. 1 to 3. The yarn-feeding drum 10 of cage type is rotatably mounted on a spindle 11, including plural circular rods 13 forming the yarn-feeding circumference, an upper cap 12 and a lower cap 15. The ring device 50 of the present invention is disposed on a first portion 17 of the circumference of the yarn-feeding drum, while the second portion 18 thereof is not ringed by the ring device 50. The circumference of the ring device 50 is pressed and driven by a yarn-feeding belt 20, as shown in FIGS. 1 and 3. The yarn 30 is guided by a yarn guide 40 and pressed between the belt 20 and ring device 50 to advance along with the belt 20. Because the ring device 50 fixedly binds the circumference of the yarn-feeding drum 10, and the yarn 30 is pressed between the belt 20 and slip-proof elastic ring device 50, the yarn 30 therefore advance steadily and accurately due to the frictional force of the belt 20 and ring device 50.

As shown in FIG. 3, the inner circumference of the ring device 50 is formed with plural grooves 52 intermingled with plural protrusions 51. When the ring device 50 is disposed on the first portion 17 of the outer circumference of the yarn-feeding drum, the grooves 52 and protrusions 51 are right fitted to the circular rods 13 and the spaces therebetween respectively. Therefore, once the ring device 50 is located on the yarn-feeding drum, no slipping movement will occur. Furthermore, the inner diameter d of the ring device 50 is smaller than the outer diameter D of the yarn-feeding drum 10 so that the ring device 50 can be fixedly fastened to the yarn-feeding drum only via its elastic binding force without any adhesive, performing yarn-feeding and non-feeding operations.

Figure 6:
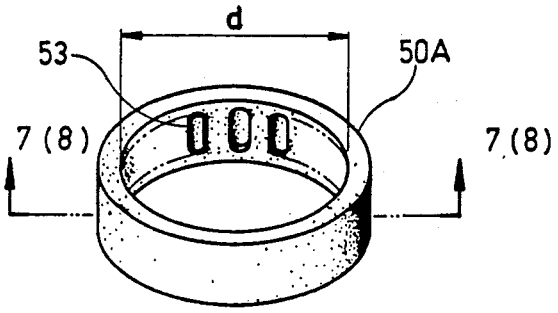
FIG. 6 is a perspective view of ring device of the embodiment shown in FIG. 4.
Figure 7A:
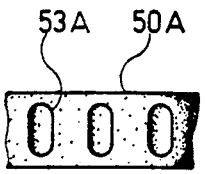
FIG. 7A is a sectional view taken on line 7—7 of FIG. 6.
Figure 7B:
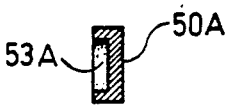
FIG. 7B is a side view according to FIG. 7A.
Figure 11:
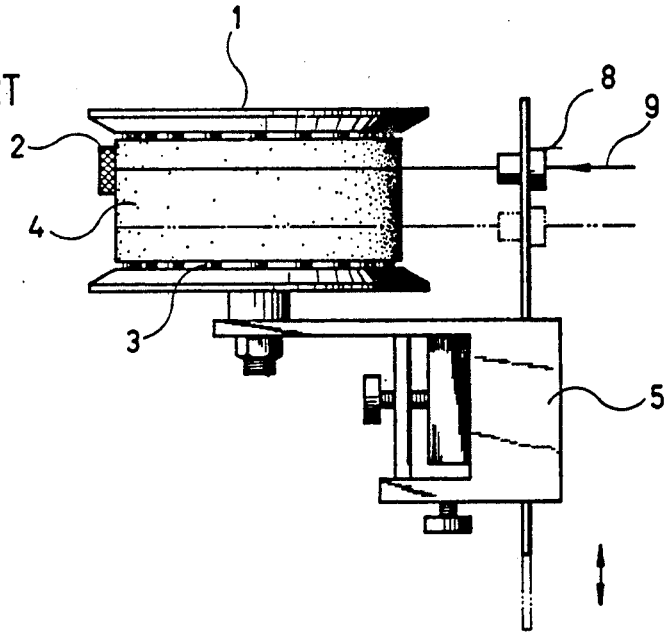
FIG. 11 PRIOR ART
FIG. 11 shows another conventional yarn-feeding wheel.
Figure 10:
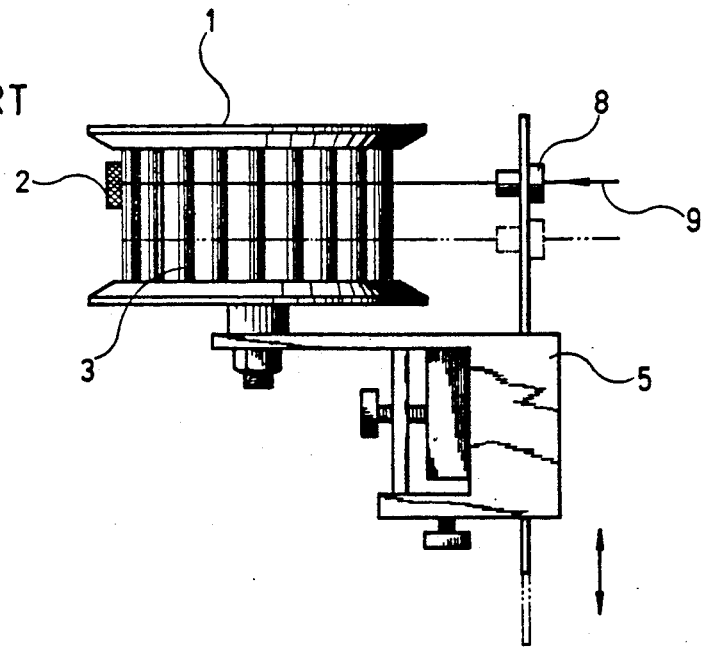
FIG. 10 PRIOR ART
FIG. 10 shows a conventional yarn-feeding wheel.

Another preferred embodiment of the present invention is shown in FIGS. 6, 7A and 7B.

Figure 4:
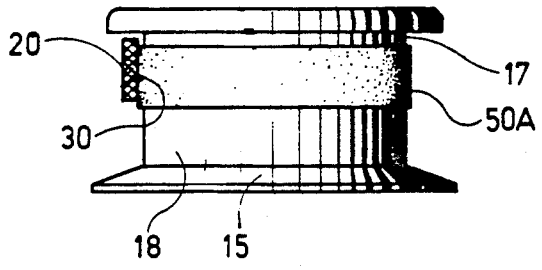
FIG. 4 shows another preferred embodiment of the present invention.
Figure 5:
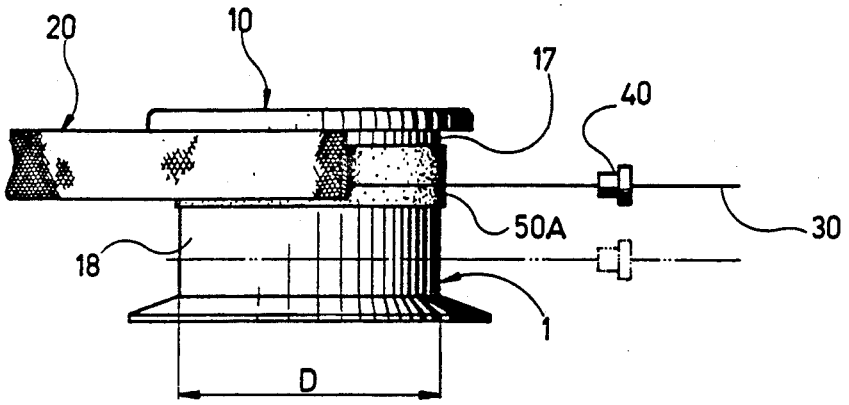
FIG. 5 shows the embodiment of FIG. 4 with the yarn-feeding belt disposed.
Figure 8A:
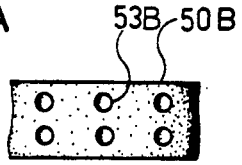
FIG. 8A shows an alternative ring device of the present invention.
Figure 8B:
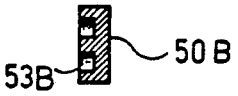
FIG. 8B is a side view according to FIG. 8A.

The ring device 50A is formed with plural evenly arranged recesses 53A on its inner circumference. Alternatively, as shown in FIGS. 8A and 8B, the ring device 50B is formed with smaller recesses 53B on its inner circumference. These ring devices 50A and 50B are fitted to the circumference of a yarn-feeding drum of close solid type as shown in FIGS. 4 and 5. The inner diameter of the ring devices 50A, 50B is smaller than the outer diameter D of the yarn-feeding drum 10 so that when the ring devices are extended to ring the yarn-feeding drum 10, the ring devices exert an elastic binding force on the drum and closely associate with the first portion 17 thereof. Additionally, the air contained in the recesses 53A and 53B is compressed to escape therefrom when the ring devices 50A and 50B are pressed by belt 20, forming a sucking effect to enhance the binding force of the ring devices 50A and 50B. Therefore, the yarn-feeding and non-feeding operation can be further exactly performed.

As illustrated in FIG. 4, the ring device forms a sight boss portion on the circumference of the yarn-feeding drum. As the ring device is pressed by the yarn-feeding belt 20, the ring device is urged to further closely adhere to the yarn-feeding drum and the yarn 30 is sunk into the ring device, creating a slip-proof effect (as shown in left side of FIG. 4). Hence, a better yarn-feeding and wheel rotation effect can be acquired.

Figure 9:
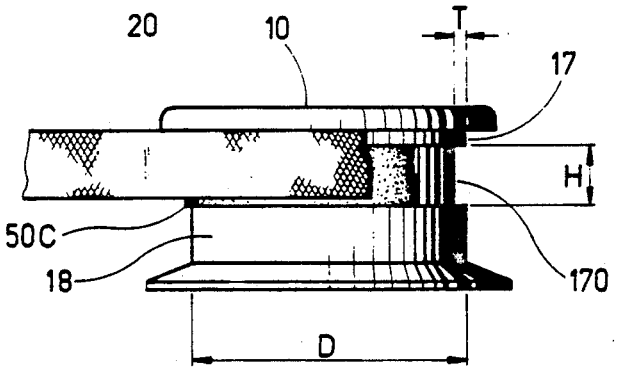
FIG. 9 shows still another embodiment of the present invention.
Figure 9A:
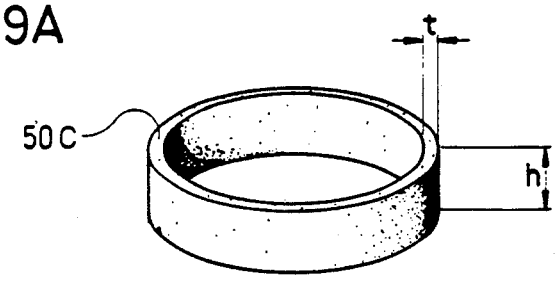
FIG. 9A shows a further alternative ring device of the present invention used in FIG. 9.

Furthermore, another preferred embodiment of the present invention is shown in FIG. 9. The circumference of the yarn-feeding drum is formed with a first annular concavity portion 170 whereby a ring device 50C having both plane inner and outer surfaces is fixedly fitted to the first concavity portion 170, slightly protruding beyond the second portion. Similarly, the ring device 50C can be pressed and driven by the yarn-feeding belt 20 to achieve the aforesaid accurate yarn-feeding effect.

It should be noted in the embodiment of the present invention as shown in FIG. 9, the thickness t of the ring device 50C is larger than the depth T of the annular concavity portion 170 of the yarn-feeding drum, and the width h of the ring device 50C is larger than the height H of the concavity portion 170 of the yarn-feeding drum so as to enable the ring device to be fixedly mounted to the first portion of the circumference of the yarn-feeding drum, so that when the ring device 50C having relative small diameter is extended to be fitted to the yarn-feeding drum having relative large diameter, the thickness and width of the ring device is consequently decreased to fittedly associate with the concavity portion 170 for performing the same function as aforesaid embodiment.

The above-mentioned ring devices of the present invention are made from elastic material and can be manually stretched to closely bind the yarn-feeding drum, and no parts is needed to be detached. Therefore, the operation of the devices is quite simple.

As indicated, the ring devices herein described include three embodiments the first is formed with plural grooves on the inner surface; the second has plane inner and outer surfaces; while the third is formed with plural recesses. However, these structure and shapes can be changed corresponding to the yarn-feeding conditions and the types of yarn-feeding drums to which the ring device is fitted. Importantly, the ring device of the present invention is elastic and smaller than the circumference of the yarn-feeding drum in diameter, and can be fixedly located around a portion thereof (not whole surface) to bind up and assoicate with the circumference of the yarn-feeding drum. Furthermore, the outer surface of the ring device can be plane-shaped or formed with concaves and convexes to achieve best yarn-feeding effect without slipping. Moreover, after a period of use, the ring device can be replaced with a new one without detaching any parts from the yarn-feeding drum.

I claim:

1. An improved yarn-feeding apparatus of the type wherein a yarn-feeding drum is rotatably mounted on a spindle, and wherein fed yarn is guided by a yarn guide movably mounted beside said drum and pressed and fed between an endless yarn-feeding belt and the yarn-feeding drum to be carried by the belt, wherein the improvement comprises:

the circumference of said yarn-feeding drum including a first portion and a second portion, the first portion having a top edge and the second portion having a bottom edge;

a slip-proof elastic yarn-feeding ring device removably mounted in said first portion of the yarn-feeding drum, said elastic ring device having a diameter smaller than that of said first portion of the yarn-feeding drum, whereby when said elastic ring device is extended to fixedly ring said first portion of the circumference of the yarn-feeding drum via its elastic binding force, the ring device thickness and width are consequently reduced.

2. An improved yarn-feeding apparatus as claimed in claim 1, wherein said slip-proof elastic yarn-feeding ring device rings on said first portion of the yarn-feeding drum forming a slight boss portion whereby when pressed by the yarn-feeding belt, said boss portion becomes almost flush with the circumference of the yarn-feeding drum and the yarn is sunk into said ring device to thereby create a yarn slip-proof effect.

3. An improved yarn-feeding apparatus as claimed in claim 1, wherein the fed yarn is pressed and fed between the yarn-feeding belt and said slip-proof elastic ring device when said yarn guide is operatively moved to guide said yarn toward said first portion of said drum; and when said yarn guide is operatively moved to guide to second portion of said drum said yarn will be fed away from said feeding belt and stayed on said second portion circumference of said drum.

4. An improved yarn-feeding apparatus as claimed in claim 1, wherein said slip-proof elastic ring device is manually removed and fitted to said first portion of the yarn-feeding drum.

5. An improved yarn-feeding apparatus as claimed in claim 1, wherein said slip-proof elastic ring device has an inner circumference formed with plural recesses, and the yarn-feeding drum has a close solid circumference whereby when said elastic ring device is fitted to the yarn-feeding drum and pressed by the yarn-feeding belt thereagainst, air contained in said recesses is compressed to escape therefrom, creating a sucking effect to enhance an adhesive binding force exerted by said elastic ring device on the yarn-feeding drum.

6. An improved yarn-feeding apparatus as claimed in claim 1, wherein said first portion of the yarn-feeding drum has an annular concave portion whereby said slip-proof elastic ring device is fittedly fitted to said concave portion and is pressed by the yarn-feeding belt to feed the yarn pressed between said ring device and the yarn-feeding belt via frictional force.

7. An improved yarn-feeding apparatus as claimed in claim 6, wherein the thickness and the width of said slip-proof elastic yarn-feeding ring device are slightly larger than a depth and a height of the annular concave portion depth and height of said drum respectively, so as to enable said ring device to be fixedly mounted to said first portion of the circumference of the yarn-feeding drum.

8. An improved yarn-feeding apparatus as claimed in claim 1 wherein said ring device is mounted at the position slightly lower than the top edge of said first portion of said yarn-feeding drum and the top edge of said yarn-feeding belt presses in aligned position with the top edge of said first portion, so that a lower edge of said ring device is free from being pressed by said yarn-feeding belt.

* * * * *